US005339661A

United States Patent [19]

Eisermann

[11] Patent Number: 5,339,661

[45] Date of Patent: Aug. 23, 1994

[54] MAGNETIC CARD LOCK WITH KEY CARD

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 910,026

[22] PCT Filed: Jan. 7, 1991

[86] PCT. No.: PCT EP91/00016

§ 371 Date: Jul. 16, 1992

§ 102(e) Date: Jul. 16, 1992

[87] PCT Pub. No.: WO91/10798

PCT Pub. Date: Jul. 25, 1991

[30] Foreign Application Priority Data

Jan. 17, 1990 [DE] Fed. Rep. of Germany ..... 4001153

[51] Int. Cl.[5] ..... E05B 47/00

[52] U.S. Cl. ..... 70/276; 70/387; 70/408; 70/413; 70/432

[58] Field of Search ..... 70/276, 413, 441, 432, 70/453, 454, 405, 408, 387, 361, 345, DIG. 59

[56] References Cited

U.S. PATENT DOCUMENTS

| | | | |
|---|---|---|---|
| 1,077,120 | 10/1913 | Boldizs | 70/408 |
| 3,271,983 | 9/1966 | Schlage | 70/276 |
| 3,588,397 | 6/1971 | Ellefson | 70/387 X |
| 3,834,197 | 9/1974 | Sedley | 70/276 X |
| 3,995,460 | 12/1976 | Sedley | 70/210 |

FOREIGN PATENT DOCUMENTS

| | | | |
|---|---|---|---|
| 0242142 | 10/1987 | European Pat. Off. . | |
| 0356334 | 2/1990 | European Pat. Off. | 70/276 |
| 2629346 | 1/1978 | Fed. Rep. of Germany | 70/413 |
| 3702730 | 8/1988 | Fed. Rep. of Germany . | |
| 0136480 | 5/1990 | Japan | 70/276 |

OTHER PUBLICATIONS

IBM Technical Disclosure Bulletin, vol. 9, No. 3, Aug. 1966, p. 314.

*Primary Examiner*—Lloyd A. Gall
*Attorney, Agent, or Firm*—Martin A. Farber

[57] ABSTRACT

The present invention relates to a magnetic card lock with key card which can be inserted into an insertion shaft with gripping opening, the key card being first insertable up to a first stop position, and in which position the key code is requested, and thereupon displaceable by an actuation distance up into the second stop position; in order to obtain a solution which is particularly easily manipulated, it proposes that the broad surface of the key card on its end facing away from the direction of insertion have a visibly differentiated first partial surface (100) which fills up the surface of the gripping opening (107) and is visible in the second stop position.

5 Claims, 7 Drawing Sheets

FIG. 2
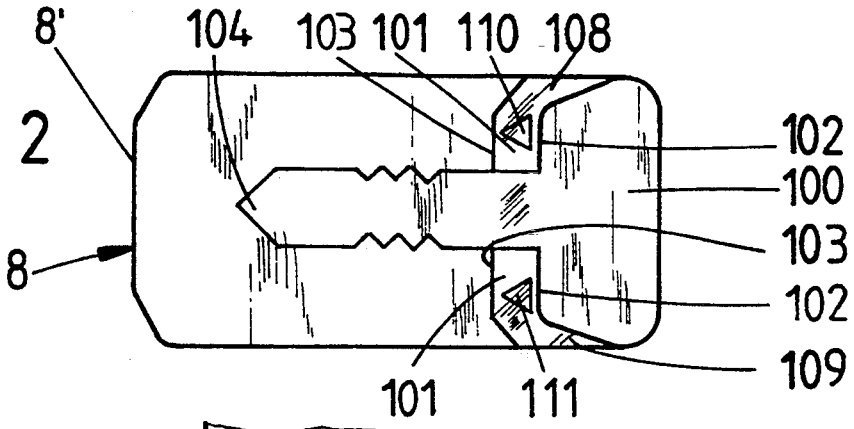
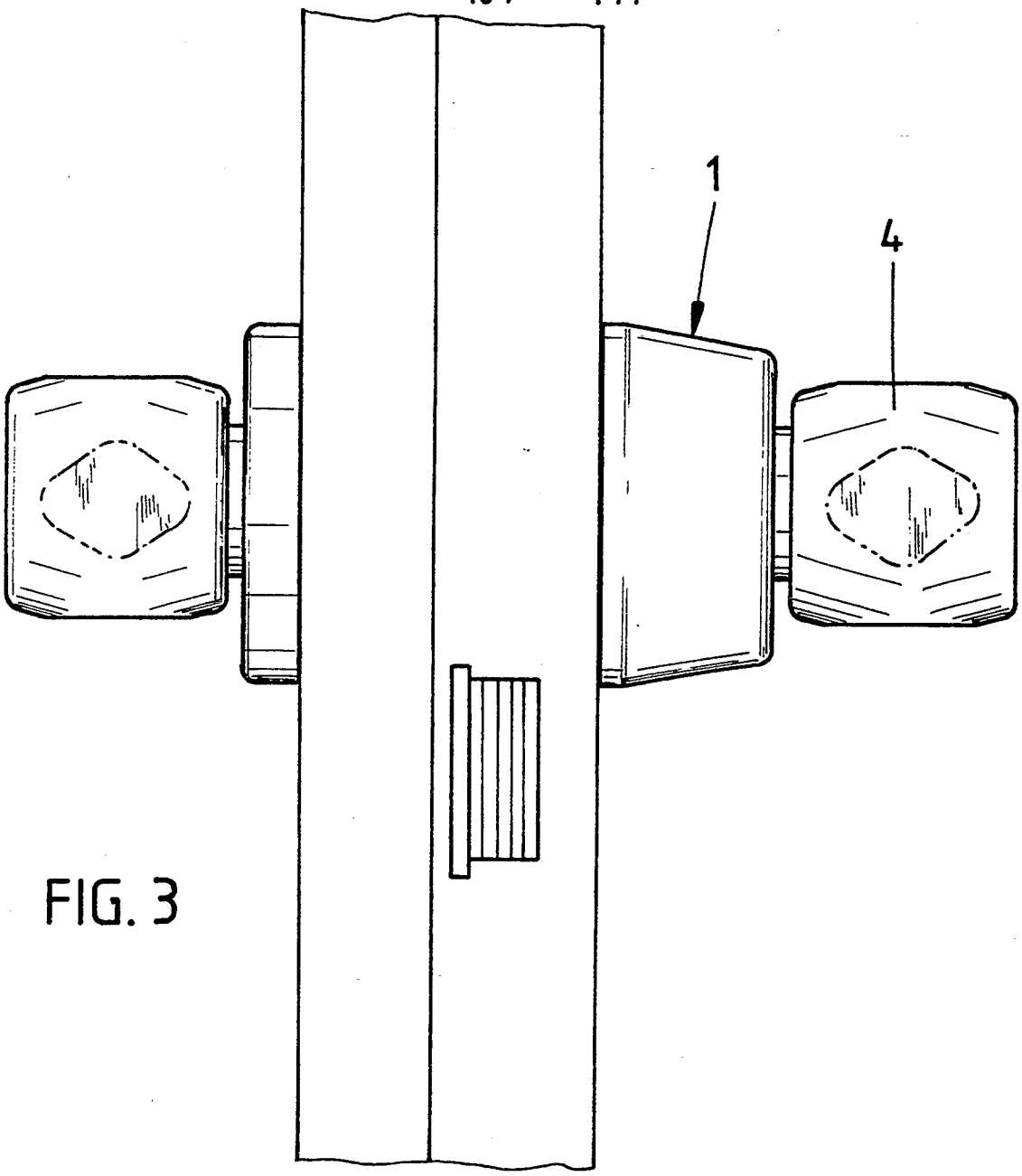
FIG. 3

MAGNETIC CARD LOCK WITH KEY CARD

FIELD AND BACKGROUND OF THE INVENTION

The present invention relates to a magnetic card lock with key card in accordance with the preamble to the main claim.

Magnetic card locks with key cards have been known for a long time. Thus, Federal Republic of Germany OS 37 02 730 discloses a magnetic card lock having permanent magnets which are arranged in the key card and the position and polarization of which form the key code. The basic construction of a magnetic card lock can be noted from European Patent Application 242 142, the lock having an insertion slot for a key card which is developed as a magnetic card. The lock has a displaceable slide into which the magnetic card can be inserted up to a first stop position. If the coding of the magnetic key card is correct, this slide can be displaced along an actuation path up into a second stop position by pushing the magnetic card further into the lock housing. This displacement effects the release of the closing device. In the first stop position, the inquiry position, magnetic tumbler pins of the inner mechanism are moved by interaction with the permanent magnets of the key card which are associated with them. A key card bearing the correct key code can then be moved up into a second stop position, the position of release.

In order to avoid erroneous switchings and provide assurance as to whether a correctly coded key or an incorrectly coded key has been inserted, it is therefore desirable to obtain from the lock information as to which closure position it is in.

SUMMARY OF THE INVENTION

The object of the invention is therefore so to develop a key card of this type that a visible indication of the position of the closure mechanism is provided by simple means.

As a result of such a magnetic card lock with key card according to the invention, the position of the closure mechanism can be noted at any time. If the key card is first pushed into the magnetic card lock up into the first stop position, the inquiry position, then, alongside the first partial surface, also the second partial surface is visible, it for instance being of a color different from the first partial surface in order to distinguish it visually from the latter. The position of the closing device (inquiry position) can immediately be noted by the visibility of the second partial surface. A user can note even from afar that the closure device is not released. In order to obtain the release of the lock, it is rather necessary to insert the key card into the lock by an actuation distance up to the second stop position (release position). If the key card bears the correct coding, the second partial surface is then no longer visible. An incorrectly coded key card can be immediately recognized in the case of a magnetic card lock of this type without actuation of the lock having to be effected, since the second partial surface, which forms an insertion-marking strip, does not disappear. In accordance with another advantageous development, the first partial surface is continued in the direction of insertion by a tapered section. In this way, the user obtains information as to the correct direction of insertion of the key card. The tip of the first partial surface lies approximately on that transverse line of the key card which corresponds upon the pulling out of the key card at the time of the elimination of the release position. In this way, a visible indication is given of the distance by which the card must be pulled out until the actuatability of the lock is eliminated, this distance being greater than the actuation distance. Another development of the key card provides developing the second partial surface as a strip the width of which corresponds to the actuation distance and of providing, on the other side of said strip, a third optically differentiated partial surface which approximately fills the entire surface of the gripping opening upon reaching the key removal position which leads to the cancelling of the release. In this way also the elimination of the release of the lock is optically indicated. The second surface region which indicates the inquiry position of the lock can, in accordance with another development, have wedges which extend on both sides alongside the first partial surface on the longitudinal edges of the key card so that they lie free in the first stop position and are substantially covered by the key card insertion rails in the second stop position. The second surface region can furthermore have arrows pointing in the direction of insertions the tips of which terminate in front of the end edge of the gripping opening in the inquiry position. In this way the user is given additional information to push the key card which has been inserted in the lock into the inquiry position further up to the second stop position in order to release the closing device. One substantial advantage of the invention resides in the fact that in this way it is possible, without effecting any change in existing locks, to provide them subsequently with a visible indication, in which connection, in addition to the function on bearing the key code, the key card can also be used as a sort of measuring stick in order to indicate the position of the slide within the lock and thus the position of its closing device.

BRIEF DESCRIPTION OF THE DRAWINGS

With the above and other advantages in view, the present invention will become more clearly understood in connection with the detailed description of a preferred embodiment, when considered with the accompanying drawings, of which:

FIG. 2 shows a key card;

FIG. 3 shows a door with magnetic card lock in front view;

DETAILED DESCRIPTION OF THE PREFERRED EMBODIMENT

Figure 1:
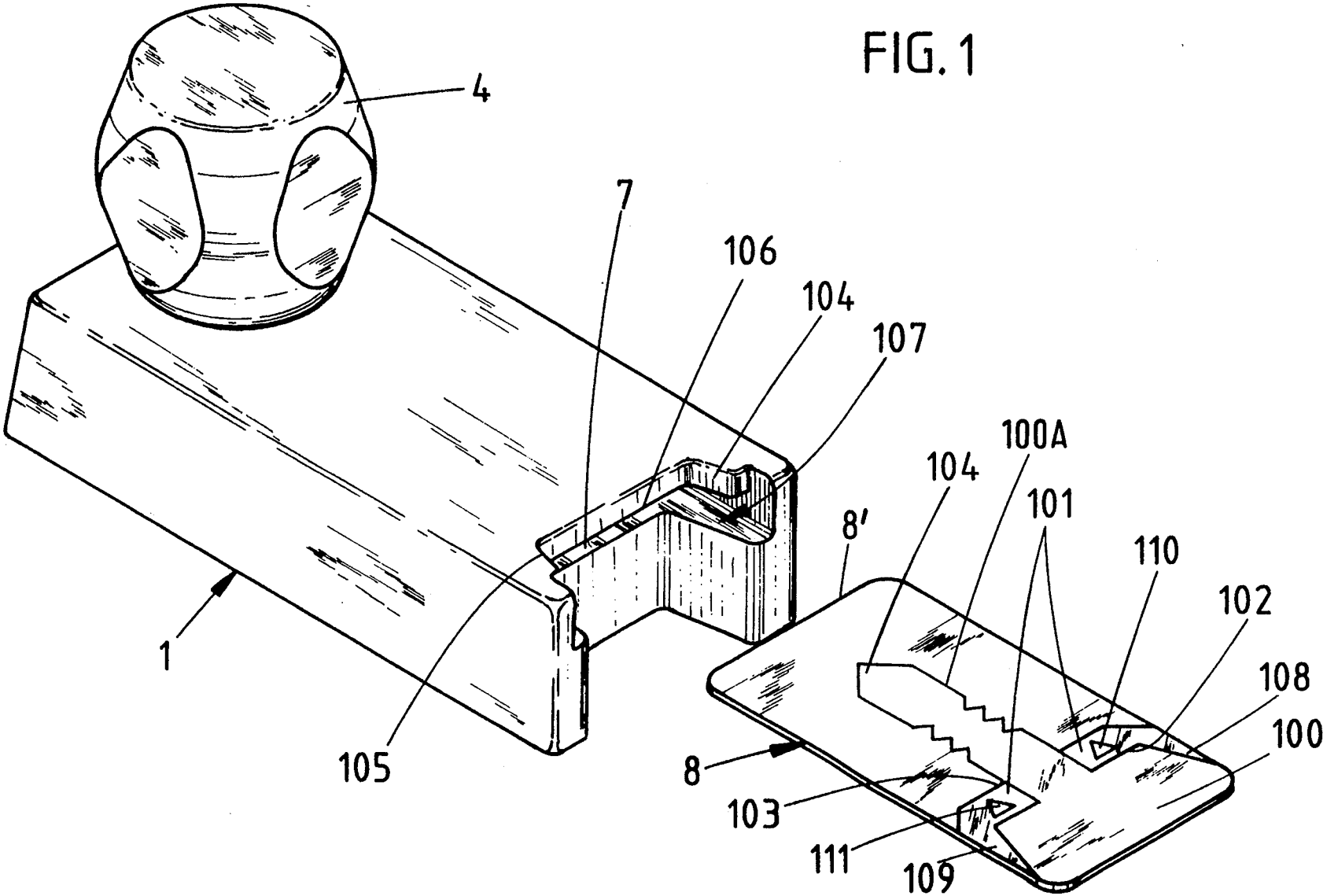
FIG. 1 shows a magnetic card lock with magnetic card, seen in perspective.
Figure 4:
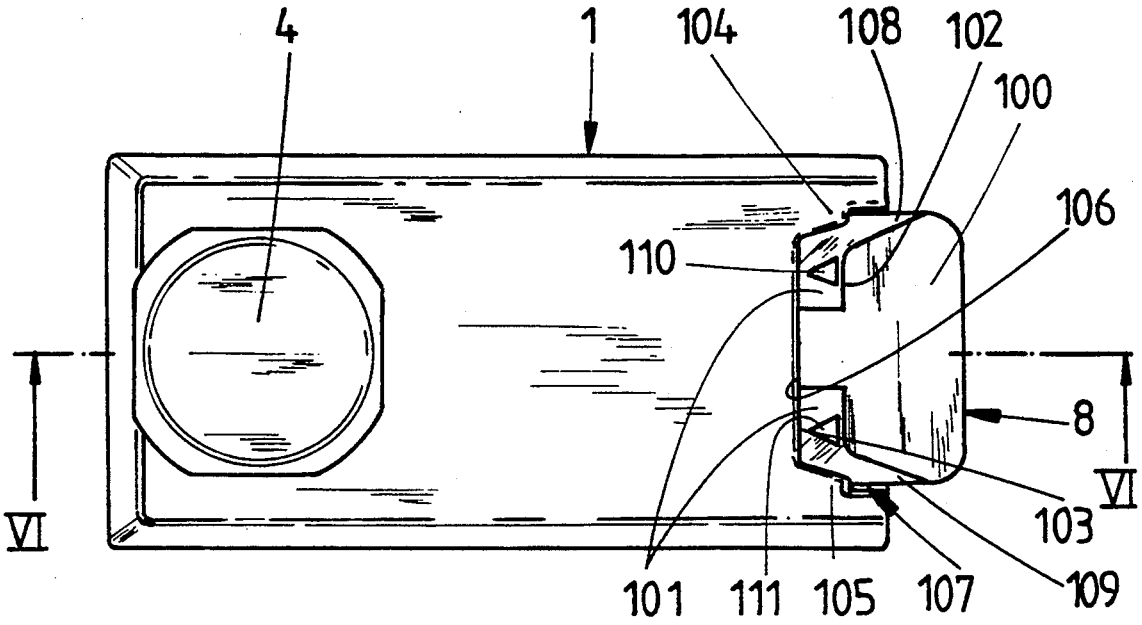
FIG. 4 shows a magnetic card lock with key card inserted into inquiry position.
Figure 5:
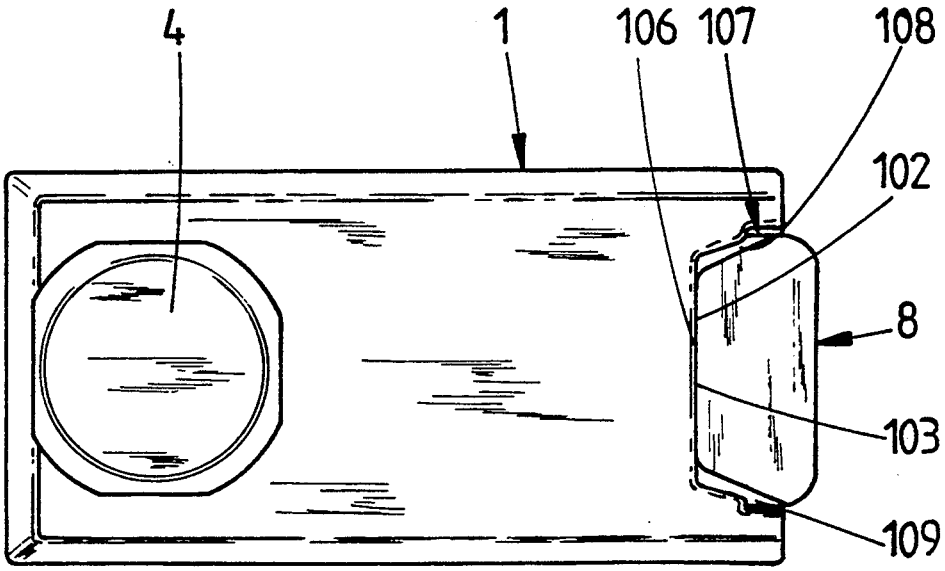
FIG. 5 shows a magnetic card lock with key card inserted into release position.
Figure 6:
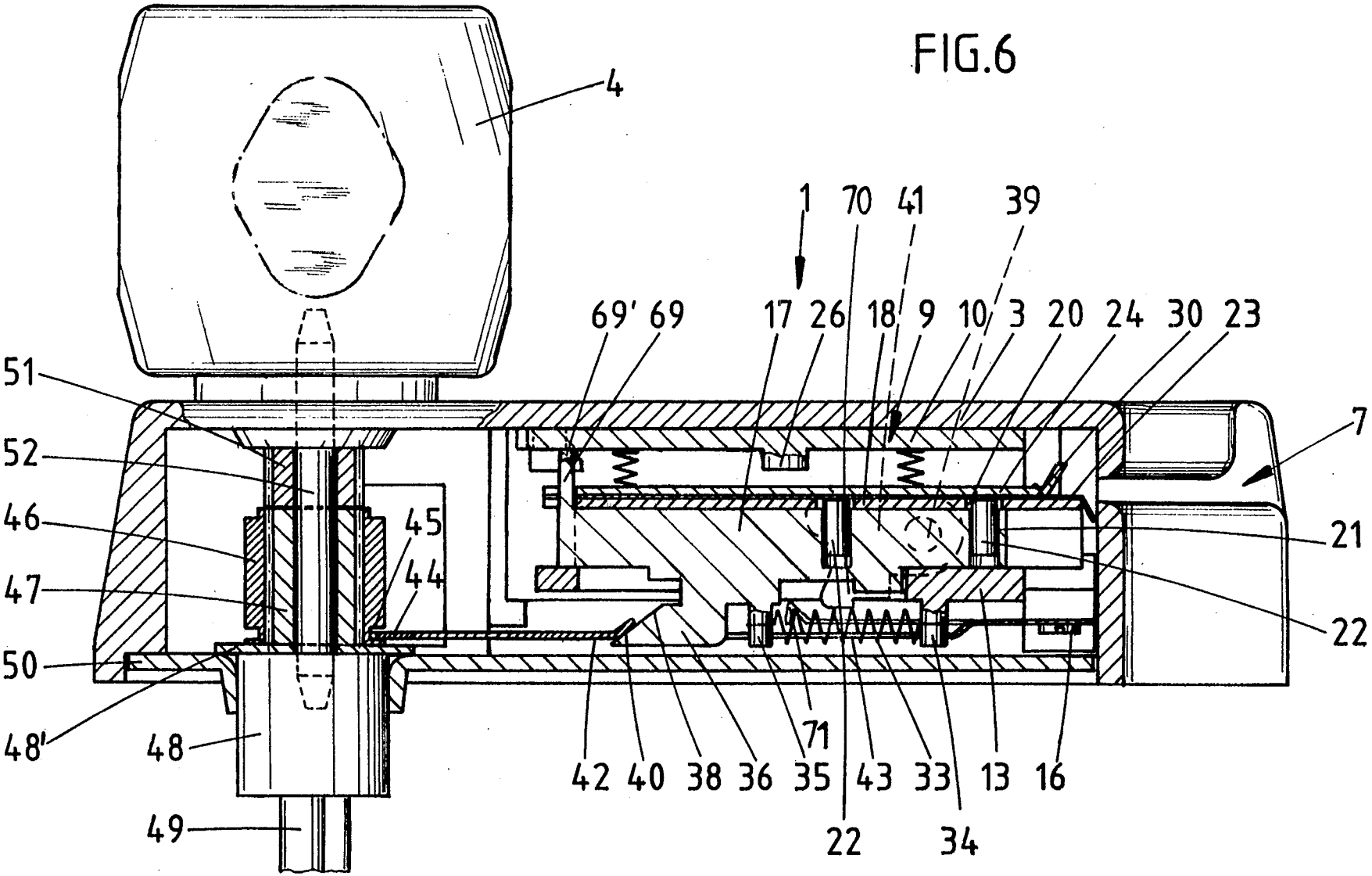
FIG. 6 is a section through a magnetic card lock along the line VI—VI of FIG. 4, but without the key card inserted.

The key card 8 shown in FIGS. 1–5 has a visibly differentiated region 100. This first partial surface 100 is arranged in front of the second partial surface 101 which extends from one longitudinal edge transversely over the surface of the card to the other longitudinal edge, interrupted by a tapered section 100A of the first partial surface 100. The upper edge 102 of the second partial surface is so arranged that, as can be noted particularly clearly from FIG. 5, when the key card is inserted up to the release position, it is on a line with the front edge 106 of the gripping opening 107. In this position, the knob 4 is coupled to the actuating bar 49 by displacement of the coupling sleeve 46. The wedges 108, 109 of the second partial surface 101 are so arranged on both sides of the first surface that they are visible in the FIG. 4 position. Upon further advancement of the key card from this position for insertion up to the release position, the wedges 108, 109 are substantially covered by the insertion rails 104, 105. The base line 103 of the second partial surface is so positioned that when the key card is inserted up to the inquiry position, it is on a line with the front edge 106 of the gripping opening 107.

The second partial surface 101 has arrows 110, 111 on both sides of the tapered section 100A of the first partial surface 100, the arrows pointing in the direction of insertion and their tips terminating before the base line 103.

The tip 104 of the section 100A of the first partial surface 100 is located on a line with the front edge 106 of the gripping opening 107 at the moment when, upon the pulling out of the key card 8, the lock becomes secured. The knob 4 is then disengaged from the actuating bar 49 by displacement of the coupling sleeve 46.

The magnetic card lock 1, shown in FIGS. 6–9, has a lock case 3 of rectangular contour fastened on the outside of the door which at its one end supports an outside turn handle 4 by means of which a bolt (not shown) or a latch can be pulled back. The lock case 3 on its other end has an insertion slot 7 for a key card which is magnetized in regions thereof.

The lock case 3 contains a housing 9 which has a cover 13 which is attached by screws 16 to the housing 9.

On the lower side of the cover a slide 17 is guided consisting of plastic, which is of plate shape. The guide surface opposite the cover 13 forms an apertured brass plate 18 which is inserted into the housing 9 from the cover side. The holes 20 in the apertured plate 18 are aligned, in the position of the lock 1 shown in FIG. 6 (latched position) with corresponding mounting recesses 21 of the slide 17, the holes extending through the slide. Magnetic tumbler pins 22 lie in the mounting recesses 21. It is not necessary to provide a tumbler pin 22 in each mounting recess 21 since the number, position and polarity of the tumbler pins 22 depends on the corresponding code of the lock 1.

A copper guide plate 23 lies on the apertured plate 18, facing which there is an armature plate 24. The latter is held in position by compression springs. The armature plate 24 consists of ferromagnetic material, in contradistinction to the other parts. Thus, the armature plate 24 attracts the magnetic tumbler pins 22, as a result of which they enter into in the holes 20 in the apertured plate 18. In this position, the slide 17 cannot be pushed out of its basic position shown in FIG. 6, since the engagement of the tumbler pins 22 in the apertured plate 18 which is fixed to the housing prevents this.

Both the armature plate 24 and the guide plate 23 adjoin the insertion slot 7 of the lock case 3. Their facing wall surfaces form the key card shaft 30.

A tension spring 33, which serves as return spring, has its one end fixed to a transverse pin 34 of the cover 13. The other end of the tension spring 33 engages on a projection 35 of the slide 17. In this way, the slide is moved into a basic latched position (shown in FIG. 6) limited by a stop 13A (this stop 13A is shown unabutted in FIG. 8). The bevel 38 of the projection 36 of the slide 17 is developed in the same direction. It engages on the oblique surface 40 of a web 42 of a tongue 43 consisting of spring material. The tongue is inserted, form-locked, on the top side of the cover 13 and fastened by the cover screws 16. The oblique surface 40 of the web 42 is formed in this connection by a bend which is directed away from the bevel 38 and extends, in basic position, in its immediate vicinity; see FIG. 6.

The fork-shaped free end 44 of the tongue 43 engages into an annular groove 45 in a coupling sleeve 46. The sleeve is internally toothed. In accordance with the uncoupled basic position (see FIG. 6), the coupling sleeve 46 surrounds solely the gear wheel 47. The latter is continued as a mounting sleeve 48 having the square pin 49 which is coupled with a door lock. The mounting sleeve 48 is turnably mounted in lock-case bottom plate 50. The mounting sleeve is provided with assurance against being pulled off by a radially outwardly directed collar 48' which is provided on it and rests against the inside of the lock-case bottom plate 50. Opposite the gear 47 there is a gear 51. The two gears 47, 51 have identically shaped toothing and are adapted to the inner toothing of the coupling sleeve 46. The gear 51 on its part is, however, firmly attached to the outer turn handle 4. In order to stabilize the position of the gears 47, 51 with respect to each other, a central pin 52 is provided which, however, does not affect the turnability of the gears 47, 51. The length of the gear 47 corresponds approximately to that of the coupling sleeve 46. In uncoupled position, the inner end side of the coupling sleeve 46 terminates in front of the facing end side of the gear 51. Turning the outer turn handle therefore does not result in the carrying along of the gear 47 and thus the square p in 49.

The slide 17 can be engaged in its forward displaced position (release position). For the engagement, detent projections 70 are provided which are urged under spring action transverse to the displacement of the slide, they being formed by detent hooks 41. The latter are turnably mounted around a pin 39 in the slide 17.

Figure 7:
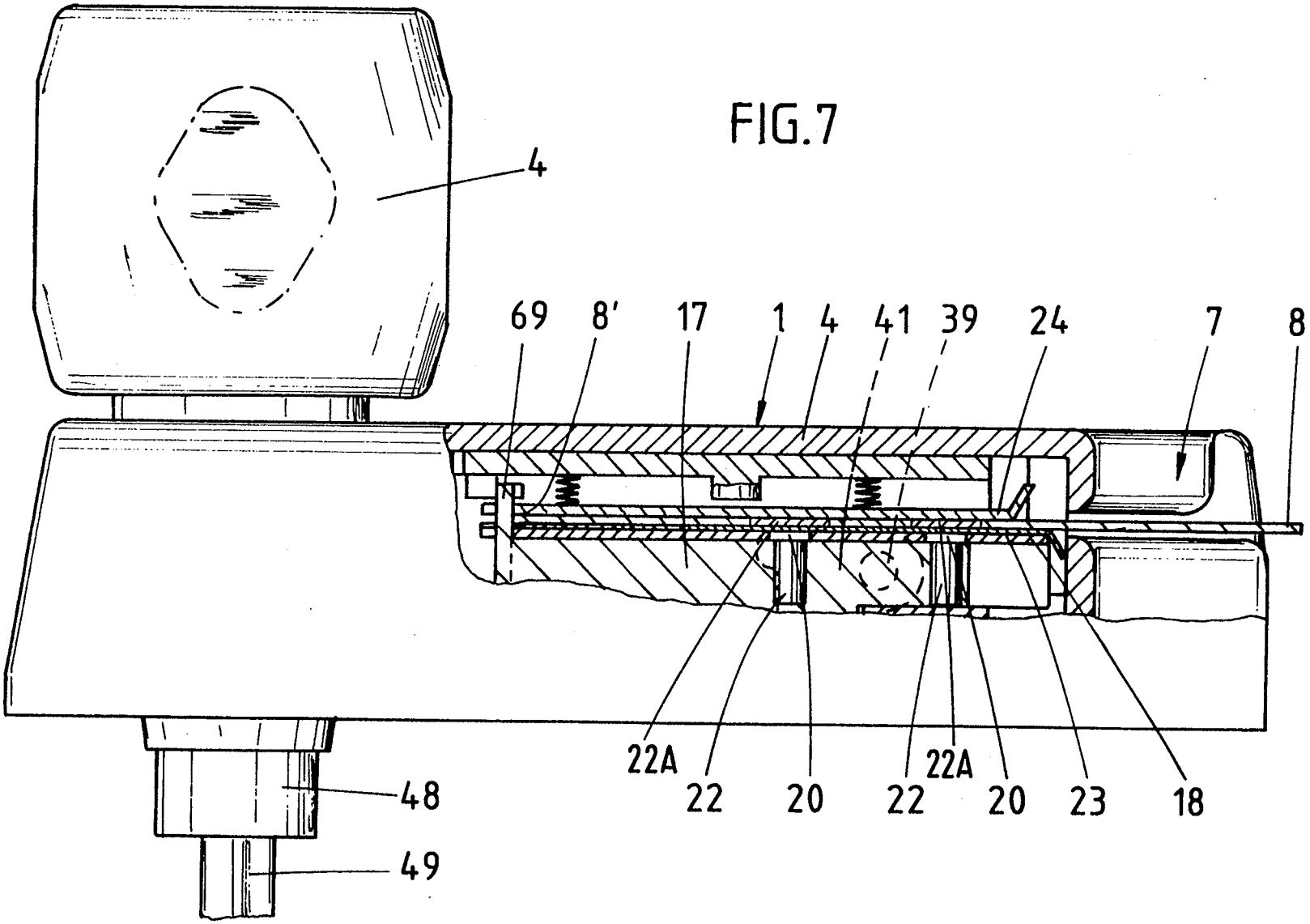
FIG. 7 shows a magnetic card lock, partly in outside view and partly in section, with key card inserted up to the inquiry position.
Figure 8:
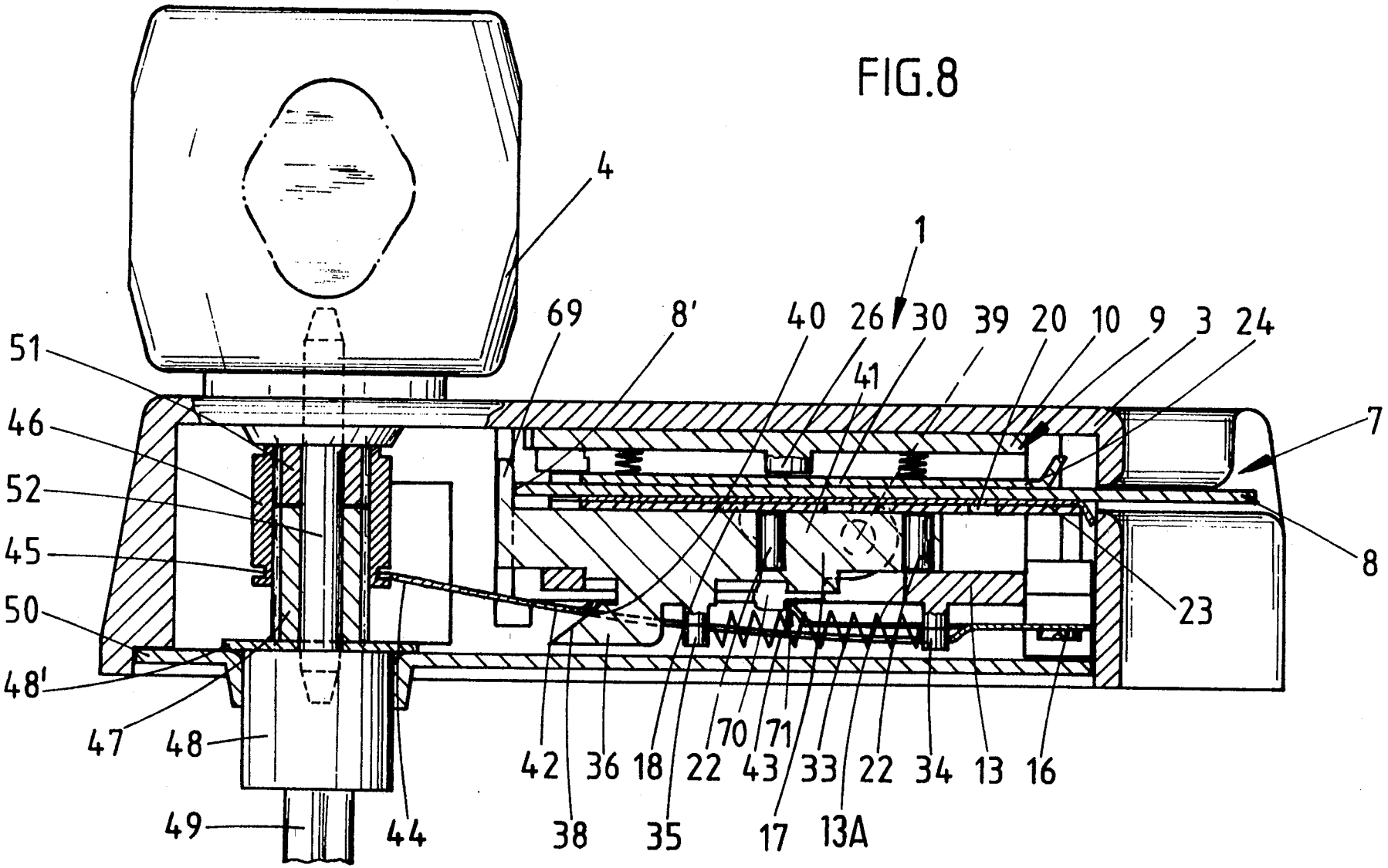
FIG. 8 is similar to FIG. 6 but with the key card inserted up to the release position.
Figure 9:
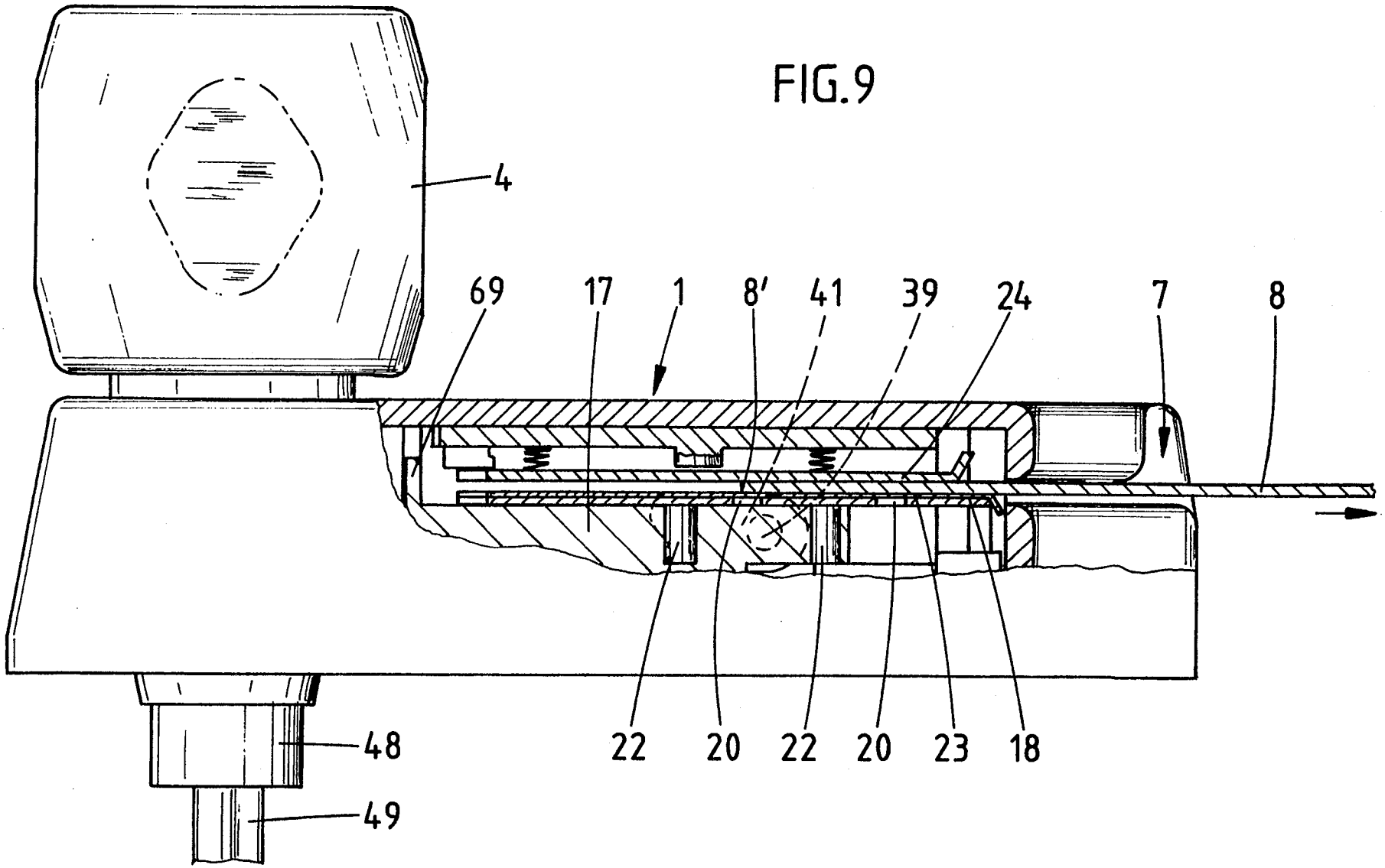
FIG. 9 is similar to FIG. 7 but in the release position showing key card position just before the eliminating of the release position by the pulling out of the card.

For the actuating of the lock from the outside by means of the outer turn handle 4, it is necessary to introduce the correctly coded key card 8 into the insertion slot 7. It thereby displaces in transverse direction the armature plate 24 which is acted on by the compression springs. The key card 8, which is inserted up to the first stop position, as depicted in FIG. 7, comes via its front edge 8' in front of the drive projection 69 of the slide 17. Furthermore, due to the magnetized regions 22A (shown in FIG. 7), the magnetic tumbler pins 22 have been so displaced that they leave the holes 20 of the apertured plate 18. Thereupon, upon the insertion movement, the detent hooks 41 which extend into the card insertion path are acted on, they being displaced accordingly in transverse direction in such a manner that the detent projections 70 then extend into openings in the cover 13. Upon the following further movement of the key card 8 by the actuation distance into the release position, the slide 17 is displaced against the force of the tension spring 33. The detent projections 70 in this connection move below the resilient stop of a leaf spring 71. As soon as the detent projections 70 have moved completely below the springs 71, the latter are fixed in position (FIG. 8). The slide 17 is thereby engaged against rearward displacement.

In hand with the forward displacement of the slide 17, the oblique surface 40 of the web 42 is displaced by the bevel 38 of the nose 36. The coupling sleeve 46 is moved into the driving position shown in FIG. 8. Both gears 47, 51 are surrounded by the coupling sleeve 46. A door lock can be actuated by means of the outer turning handle 4.

The uncoupling requires the pulling out of the key card 8. After a partial displacement, the key card releases the detent hooks 41 so that the latter can move backward under the spring 71, whereby the latch is eliminated. The return spring 33 which was tensioned upon the forward displacement pulls the slide 17 back into its basic position. Together with this there is also a rearward displacement of the coupling sleeve 46 into the uncoupled position.

I claim:

1. A magnetic card lock with key card, the lock having a closing device and including a key insertion shaft for receiving the card, the insertion shaft broadening at an upper end thereof into a grip opening and having card insertion rails, the card having a broad side and a key code in the form of magnetized regions disposed on the broad side, the lock having a first stop for positioning the card for a reading of the key code upon insertion of the card into the shaft, the lock having a second stop to which the card is displacable from the first stop along an actuation distance for release of the closing device, termination of the release of the closing device occurring upon a retraction of the card along the shaft;

wherein the broad side of the key card has, at its end facing away from the insertion direction, a visibly set-off first partial surface and a visibly set-off second partial surface being arranged in front of the first partial surface in the insertion direction;

the second partial surface has a baseline which, upon insertion of the card to the position of the first stop, is aligned with a front edge of the grip opening;

the first partial surface has a lower edge which, upon insertion of the card to the position of the second stop, is aligned with the front edge of the grip opening;

the first partial surface substantially fills the grip opening upon insertion of the card to the second stop position; and the second partial surface, upon insertion of the card to the first stop position, forms an insertion marking strip between the lower edge of the first partial surface and the front edge of the grip opening.

2. A lock and key card according to claim 1, wherein the first partial surface of the key card is continued in the direction of introduction of the card by a tapered section having a tip which is aligned with the front edge of the grip opening upon a retraction of the key card at the moment of the termination of the release of the closing device.

3. A lock and key card according to claim 1, further comprising, on both sides of the card and alongside the first partial surface, wedges which lie free in the first stop position and are substantially covered by the key card insertion rails in the second stop position.

4. A lock and key card according to claim 1, further comprising, on the second partial surface, arrows which point in the direction of insertion and terminate, in the second stop position, with their tips in front of the front edge of the grip opening.

5. A lock and key card according to claim 1, wherein the second partial surface is developed as a strip having a width equal to the actuation distance between the first and the second stop positions; and the key card has a third optically differentiated partial surface which extends on the other side of the strip, which third partial surface, when the key card removal position leading to the elimination of the release is reached, fills up approximately the entire grip opening.

* * * * *